US011696670B2

(12) United States Patent
Qian

(10) Patent No.: US 11,696,670 B2
(45) Date of Patent: Jul. 11, 2023

(54) MULTI-FUNCTIONAL INTEGRATED MACHINE FOR AUTOMATIC CARING OF FOOTWEAR

(71) Applicant: Shuang Qian, Nantong (CN)

(72) Inventor: Shuang Qian, Nantong (CN)

( * ) Notice: Subject to any disclaimer, the term of this patent is extended or adjusted under 35 U.S.C. 154(b) by 836 days.

(21) Appl. No.: 16/485,788

(22) PCT Filed: Jan. 30, 2018

(86) PCT No.: PCT/CN2018/074530
§ 371 (c)(1),
(2) Date: Aug. 14, 2019

(87) PCT Pub. No.: WO2018/149291
PCT Pub. Date: Aug. 23, 2018

(65) Prior Publication Data

US 2020/0046200 A1 Feb. 13, 2020

(30) Foreign Application Priority Data

Feb. 14, 2017 (CN) ..... 201710077391.0
Jun. 22, 2017 (CN) ..... 201710478527.9

(51) Int. Cl.
*A47L 23/02* (2006.01)
*A47L 23/20* (2006.01)

(52) U.S. Cl.
CPC ..... *A47L 23/02* (2013.01); *A47L 23/20* (2013.01)

(58) Field of Classification Search
CPC ..... A47L 23/02; A47L 23/20
USPC ..... 15/30–37
See application file for complete search history.

(56) References Cited

U.S. PATENT DOCUMENTS

2010/0306935 A1* 12/2010 De Florian ..... A47L 23/205 15/30
2011/0252585 A1* 10/2011 Lee ..... A47L 23/02 15/30

FOREIGN PATENT DOCUMENTS

| | | | |
|---|---|---|---|
| CN | 101664297 | * | 7/2009 |
| CN | 101664297 | A | 3/2010 |
| CN | 102240197 | A | 11/2011 |
| CN | 104473610 | A | 4/2015 |
| CN | 106073684 | A | 11/2016 |
| CN | 106618438 | A | 5/2017 |
| CN | 107126179 | A | 9/2017 |

(Continued)

*Primary Examiner* — Orlando E Aviles
*Assistant Examiner* — J Stephen Taylor
(74) *Attorney, Agent, or Firm* — Bayramoglu Law Offices LLC

(57) ABSTRACT

A multi-functional integrated machine for automatic caring of footwear includes a multi-color combined footwear brush system, a color selection drive system and an automatic polish ejecting system. The multi-color combined footwear brush system is respectively connected to the color selection drive system and the automatic polish ejecting system. The automatic polish ejecting system automatically ejects the polish to the multi-color combined footwear brush system. The color selection drive system drives the multi-color combined footwear brush system to switch the brush by circular motion and to polish the footwear by moving and rotating. The polish of different colors can be selected as needed and applied in the manner of automatic ejecting, which solves the technical problems of inconveniences caused by various polish applying footwear products in the prior art.

12 Claims, 9 Drawing Sheets

(56) References Cited

FOREIGN PATENT DOCUMENTS

| | | | |
|---|---|---|---|
| JP | 2003339616 | A | 12/2003 |
| WO | 9304624 | A1 | 3/1993 |

* cited by examiner

MULTI-FUNCTIONAL INTEGRATED MACHINE FOR AUTOMATIC CARING OF FOOTWEAR

CROSS REFERENCE TO RELATED APPLICATIONS

This application is the national phase entry of International Application PCT/CN2018/074530, filed on Jan. 30, 2018 which is based upon and claims priority to Chinese Patent Application No. 201710077391.0, filed on Feb. 14, 2017 and Chinese Patent Application No. 201710478527.9, filed on Jun. 22, 2017, the entire contents of which are incorporated herein by reference.

TECHNICAL FIELD

The present disclosure relates to a footwear caring product, in particular to a multi-functional integrated machine for automatic caring of footwear.

BACKGROUND

Leather shoes play an irreplaceable role in modern life. According to figures, in the year of 2009, 3.59 billion pairs of leather shoes were produced annually in China, and this number had grown to 3.9 billion in 2010. It was expected that the annual output of leather shoes in China would reach 4.28 billion, 4.73 billion and 5.2 billion by pairs in the years of 2011, 2012 and 2013, respectively, with an average annual growth rate of about 10%. Some of the commonly used methods of caring for leather shoes and their downsides are set forth below.

The first method is to polish the shoes by using an old fashioned product, i.e., a shoe polish brush. First, put a hand inside the shoe or put the shoe on a foot to stretch the shoe surface; then, apply the polish on the shoe surface and coat the shoe surface with the polish by using the shoe polish brush. A method completely relying on manual operations like this is likely to stain the hand with the polish, and the shoe polish tends to be applied unevenly. Hence, such outdated polishing method is extremely inconvenient in use.

The second method is to stretch the shoe surface by using a mechanical shoe tree, then polish the shoes. However, the existing shoe trees can simply preserve the shape of the shoes to a certain extent, and is inapplicable to a wide range of shoes of varying shapes as the shape of the shoe tree is fixed.

The third method is to polish the shoes by using a shoe polish machine. Either the automatic shoe polishing machines or the semi-automatic shoe polishing machines currently available on the market work in joint effort of the user with the shoes worn on the feet. Moreover, the shoe polishing machine can only provide the shoe polish of a single color, which fails to offer options for multiple colors. Further, the existing shoe polishing machine does not suit for various women's leather shoes with low line upper and pointed toe and offers a simple function.

SUMMARY

It is therefore an objective of the present disclosure to provide a multi-functional integrated machine for automatic caring of footwear which is capable of automatically drying, ironing and preserving the shape of footwear of any style and any size. The multi-functional integrated machine for automatic caring of footwear offers the options for footwear polish of different colors and the polish is applied on the footwear in an automatic polish ejecting manner, thereby solving the technical problems of inconvenient operations caused by various polishing products with a simple function and scattered polish dispensing in the prior art.

To solve the above-mentioned problems, the present disclosure proposes a multi-functional integrated machine for automatic caring of footwear, which includes a multi-color combined footwear brush system, a color selection drive system, and an automatic polish ejecting system. The multi-color combined footwear brush system is respectively connected to the color selection drive system and the automatic polish ejecting system. The automatic polish ejecting system automatically ejects polish to the multi-color combined footwear brush system. The color selection drive system drives the multi-color combined footwear brush system to switch the brush by circular motion and to polish the footwear by moving and rotating.

The multi-functional integrated machine for automatic caring of footwear, according to a preferred embodiment of the present disclosure, further includes a drying and ironing magnetic positioning system with an expandable capsule. The drying and ironing magnetic positioning system with the expandable capsule includes a foot-shaped electrical heated drying and ironing device and a magnetic positioning device. The foot-shaped electric-heated drying and ironing device can be placed inside the footwear to iron the footwear and preserve a shape of the footwear. The magnetic positioning device is magnetically connected to the foot-shaped electric-heated drying and ironing device for magnetically positioning a sole of the footwear.

According to the multi-functional integrated machine for automatic caring of footwear described in a preferred embodiment of the present disclosure, the foot-shaped electric-heated drying and ironing device includes a hydraulic/pneumatic footwear shape preserving device and a foot-shaped polish-proof and stain-proof protecting cover. The foot-shaped polish-proof and stain-proof protecting cover covers over the hydraulic/pneumatic footwear shape preserving device. The magnetic positioning device includes a magnetic-attraction positioning block set, a ferromagnetic positioning block set, and a foot-shaped positioning base. The magnetic-attraction positioning block set is provided on a bottom of the hydraulic/pneumatic footwear shape preserving device or a bottom of the foot-shaped polish-proof and stain-proof protecting cover, and the ferromagnetic positioning block set is provided on the foot-shaped positioning base.

According to the multi-functional integrated machine for automatic caring of footwear described in a preferred embodiment of the present disclosure, the multi-color combined footwear brush system includes a color selection positioning plate and a plurality of hollow cylindrical-shaped footwear brushes. The plurality of hollow cylindrical-shaped footwear brushes are movably provided on the color selection positioning plate. The automatic polish ejecting system is provided in a hollow portion of each hollow cylindrical-shaped footwear brush. The color selection positioning plate is provided with a plurality of execution channels. The hollow portion of each hollow cylindrical-shaped footwear brush is connected to one of the execution channels. A side wall of each hollow cylindrical-shaped footwear brush is evenly provided with a plurality polish seeping holes. The polish seeping holes are connected to the hollow portion of each hollow cylindrical-shaped footwear brush. The plurality of hollow cylindrical-shaped footwear brushes are driven by the color selection drive system.

According to the multi-functional integrated machine for automatic caring of footwear described in a preferred embodiment of the present disclosure, the color selection drive system includes a color selection gear, a color selection rack/a color selection stepper motor, a power input gear, and a multi-shaft transmission gear set. The color selection gear is fixedly connected to a central main shaft of the color selection positioning plate. A plurality of gears of the multi-shaft transmission gear set are provided on the color selection positioning plate to establish a multi-shaft transmission. The plurality of gears are respectively one-to-one connected to the hollow cylindrical-shaped footwear brushes in a driving manner. The power input gear is connected to the multi-shaft transmission gear set in a transmission manner, and the power input gear is connected to a drive motor in a driving manner.

According to the multi-functional integrated machine for automatic caring of footwear described in a preferred embodiment of the present disclosure, the multi-color combined footwear brush system further includes a separation column with concave arc-shaped side surfaces. The separation column with concave arc-shaped side surfaces is provided in the middle of the plurality of hollow cylindrical-shaped footwear brushes. A concave arc of each concave arc-shaped side surface is tangent to an outer circle of brush bristles on a corresponding hollow cylindrical-shaped footwear brush.

According to the multi-functional integrated machine for automatic caring of footwear described in a preferred embodiment of the present disclosure, the color selection drive system further includes a color selection rotary knob or a color selection stepper motor. The color selection rotary knob or the color selection stepper motor is connected to the color selection gear. The color selection rotary knob or the color selection stepper motor drives the color selection rack and the color selection gear to perform a color selection. The color selection rotary knob or the color selection stepper motor is positioned through a spring plunger or a self-locking program.

According to the multi-functional integrated machine for automatic caring of footwear described in a preferred embodiment of the present disclosure, the automatic polish ejecting system includes a hollow cylindrical polish storing barrel, an ejecting polish tank, and a lever structure. The hollow cylindrical polish storing barrel is provided in the hollow portion of each hollow cylindrical-shaped footwear brush. The ejecting polish tank may be placed inside the hollow cylindrical polish storing barrel. An ejecting nozzle of the ejecting polish tank communicates with the hollow portion of the hollow cylindrical-shaped footwear brush through a polish ejecting hole of the hollow cylindrical polish storing barrel. An end port of the hollow cylindrical polish storing barrel is connected to the execution channel. Another end port of the hollow cylindrical polish storing barrel is connected to a self-locking cover cap. The ejecting polish tank is placed inside the hollow cylindrical polish storing barrel. The self-locking cover cap locks the ejecting polish tank. The lever structure includes a lever, a plurality of push rods, and a polish dispensing push button/polish dispensing electromagnet. The plurality of push rods are provided on the lever, and the polish dispensing push button/polish dispensing electromagnet is connected to the lever. In a natural state, the plurality of push rods are located outside the execution channels. When the polish dispensing push button is pressed down or the polish dispensing electromagnet is energized, the push rods would enter the execution channels to push and press an end of the ejecting polish tank, then the ejecting polish tank starts ejecting the polish.

According to the multi-functional integrated machine for automatic caring of footwear described in a preferred embodiment of the present disclosure, a movable working platform is provided around the foot-shaped positioning base. The movable working platform is driven by a motor to move forth, back, rightward, and leftward, and swing by 0-180 degrees along the foot-shaped positioning base. The movable working platform is provided with at least one multi-color combined footwear brush system. One multi-color combined footwear brush system is driven by one color selection drive system, and one multi-color combined footwear brush system is supplied with the polish by the plurality of automatic polish ejecting systems.

According to the multi-functional integrated machine for automatic caring of footwear described in a preferred embodiment of the present disclosure, the foot-shaped positioning base is further provided with a positioning module specialized for women stilettos. A bottom of the positioning module is an iron plate. The iron plate is provided with an elastic positioning block. The elastic positioning block is provided with a conical groove.

Compared with the prior art, the present disclosure has the following technical effects.

It is an objective of the present disclosure to provide a multi-functional integrated machine for automatic caring of footwear which is capable of automatically cleaning, drying, ironing and preserving the shape of footwear of any style and any size. The multi-functional integrated machine for automatic caring of footwear offers the options for footwear polish of different colors and the polish is applied on the footwear in an automatic polish ejecting manner, thereby solving the technical problems of inconvenient operations caused by various polishing products with a simple function and scattered polish dispensing in the prior art.

Further, according to the present disclosure, the footwear is positioned by the magnetic positioning device to provide a supporting reactive force necessary for automatically polishing the footwear.

In the prior art, after the footwear is coated with the polish, it is hard to let the polish dry in a fast and good manner, so an additional footwear dryer is required to dry the footwear. Besides, drying will deform the damp and deformed footwear even harder. The integrated machine according to the present technical solution is provided with the hydraulic or pneumatic footwear shape preserving device, which not only offers drying and ironing functions, but also can preserve the shape of the footwear, so the deformed footwear can be exactly restored to its initial shape.

According to the present technical solution, a universal degerming component by employing ultraviolet light or ozone, etc., and a dust cleaner may further be mounted to offer more functions.

According to the present technical solution, a numerical control technique may further be employed to set and control the processes including color selection of the polish and the footwear brush, automatic polish dispensing amount, and footwear polishing movement through a software program.

DETAILED DESCRIPTION OF THE EMBODIMENTS

Embodiment 1

Figure 1:
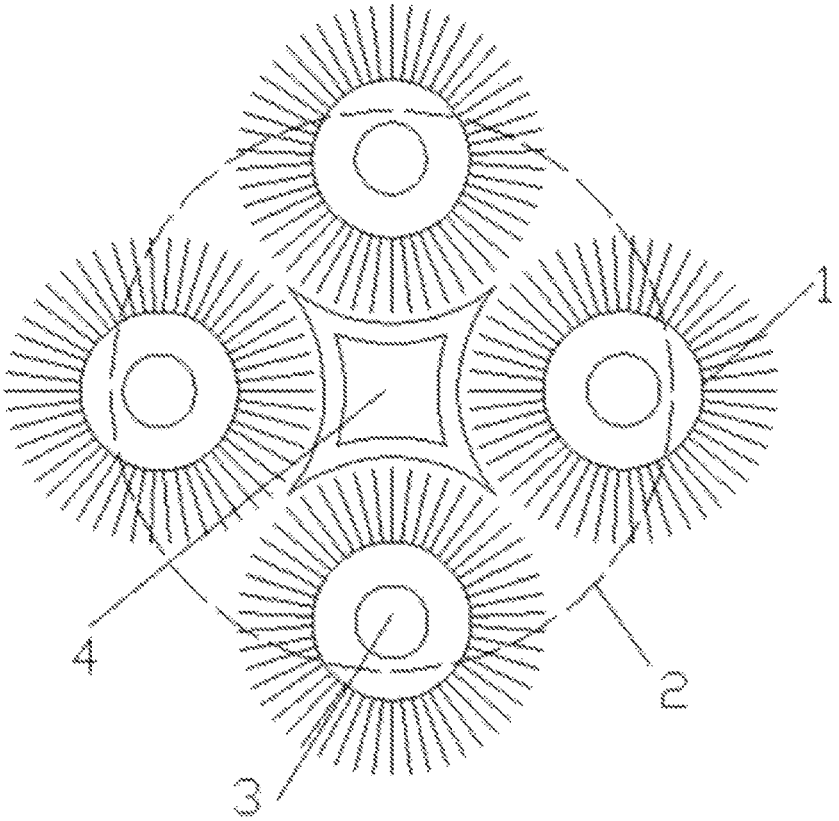
FIG. 1 is a structural diagram showing a multi-color combined footwear brush system of the present disclosure.

A multi-functional integrated machine for automatic caring of footwear includes a multi-color combined footwear brush system, a color selection drive system and an automatic polish ejecting system. The multi-color combined footwear brush system is respectively connected to the color selection drive system and the automatic polish ejecting system. The automatic polish ejecting system automatically ejects polish to the multi-color combined footwear brush system. The color selection drive system drives the multi-color combined footwear brush system to switch the brush by circular motion and to polish the footwear by moving and rotating. Each system of the present disclosure will be described in detail hereinafter with reference to the drawings.

Multi-Color Combined Footwear Brush System

As shown in FIG. 1-FIG. 6, the multi-color combined footwear brush system includes the rotary disc type color selection positioning plate 2 and four hollow cylindrical-shaped footwear brushes 1. The color selection positioning plate 2 may be mounted with a plurality of hollow cylindrical-shaped footwear brushes 1 as needed. In the present embodiment, preferably, four hollow cylindrical-shaped footwear brushes 1 are employed. The four hollow cylindrical-shaped footwear brushes 1 are a black polish brush, a brown polish brush, a colorless polish brush, and a dry cleaning brush, respectively. An outer side wall of each of the hollow cylindrical-shaped footwear brushes 1 is evenly provided with the brush bristles and the polish seeping holes 17, and the hollow inner cylindrical space of the hollow cylindrical-shaped footwear brush is used to accommodate the automatic polish ejecting system. The polish seeping holes 17 communicate with the hollow portions of the hollow cylindrical-shaped footwear brushes 1. In the present embodiment, the hollow cylindrical-shaped footwear brushes 1 are movably provided on the color selection positioning plate 2. The color selection positioning plate 2 is provided with four execution channels 3. The hollow portion of each of the hollow cylindrical-shaped footwear brushes 1 is connected to one of the execution channels 3. A side wall of the hollow cylindrical-shaped footwear brush 1 is evenly provided with a plurality of polish seeping holes 17. In the present embodiment, the four hollow cylindrical-shaped footwear brushes 1 are evenly and circumferentially arranged on the color selection positioning plate 2. The color selection positioning plate 2 is further provided with the separation column 4 with concave arc-shaped side surfaces. Four sides of the separation column 4 are all concave arc-shaped, and the separation column 4 with concave arc-shaped side surfaces is located at the middle of the four hollow cylindrical-shaped footwear brushes 1 of the color selection positioning plate 2. The concave arc-shaped surfaces are tangent to the outer circles of the brush bristles of the four hollow cylindrical-shaped footwear brushes 1. The separation column 4 with concave arc-shaped side surfaces is used to separate the multi-color footwear brushes and avoid color mixing.

Color Selection Drive System

The color selection drive system includes the color selection gear 8, the color selection rack 9, the power input gear 6, and the multi-shaft transmission gear set 5. The multi-shaft transmission gear set 5 is provided on the outer side walls of the plurality of execution channel 3 of the color selection positioning plate 2 via inner rings of bearings, and the multi-shaft transmission gear set 5 is connected to the plurality of the hollow cylindrical-shaped footwear brushes 1 in a driving manner. The color selection gear 8 is fixedly connected to the central main shaft 7 of the color selection positioning plate 2 to drive the color selection positioning plate 2 to perform a 360-degree rotation, thereby accomplishing operations of switching the brushes and the polish. The color selection rack 9 can be engaged or separated with the color selection gear 8. The color selection rack 9 is connected to the color selection rotary knob 11. The color selection rotary knob 11 pushes the color selection rack 9 and the selection gear 8 to allow the color selection. The color selection rotary knob 11 is positioned through a spring plunger. The color selection rotary knob 11 enables the four color selection positioning plates 2 (the integrated machine includes four multi-color combined footwear brush systems, and one multi-color combined footwear brush system is connected to one color selection drive system, further details will be given afterward when it comes to the movable working platform 10) to act synchronously. The multi-shaft transmission gear set 5 is horizontally mounted on the color selection positioning plate 2. According to the present embodiment, the multi-shaft transmission gear set 5 includes four transmission gears. The transmission gears are one-to-one connected to the hollow cylindrical-shaped footwear brushes 1 in a driving manner. The transmission gears drive the hollow cylindrical-shaped footwear brushes 1 to rotate. The power input gear 6 is connected to the multi-shaft transmission gear set in a transmission manner. The power input gear 6 is connected to a motor which offers the power. According to the present embodiment, the color selection positioning plate 2 is mounted on the movable working platform 10. The central main shaft 7 of the color selection positioning plate 2 passes through the movable working platform 10. The movable working platform 10 is further provided with a plurality of through holes. The plurality of through holes are coaxially connected to the execution channels 3 on the color selection positioning plate 2, respectively. Before the machine operates, the movable working platform 10 is located at an initial position, and the color selection gear 8 and the color selection rack 9 are engaged with each other. After the machine is started, the color selection gear 8 and the color selection rack 9 are disengaged. When the operation is finished, the movable working platform 10 automatically returns to the initial position. According to the present embodiment, the movable working platform 10 is of vertical type.

Automatic Polish Ejecting System

Figure 6:
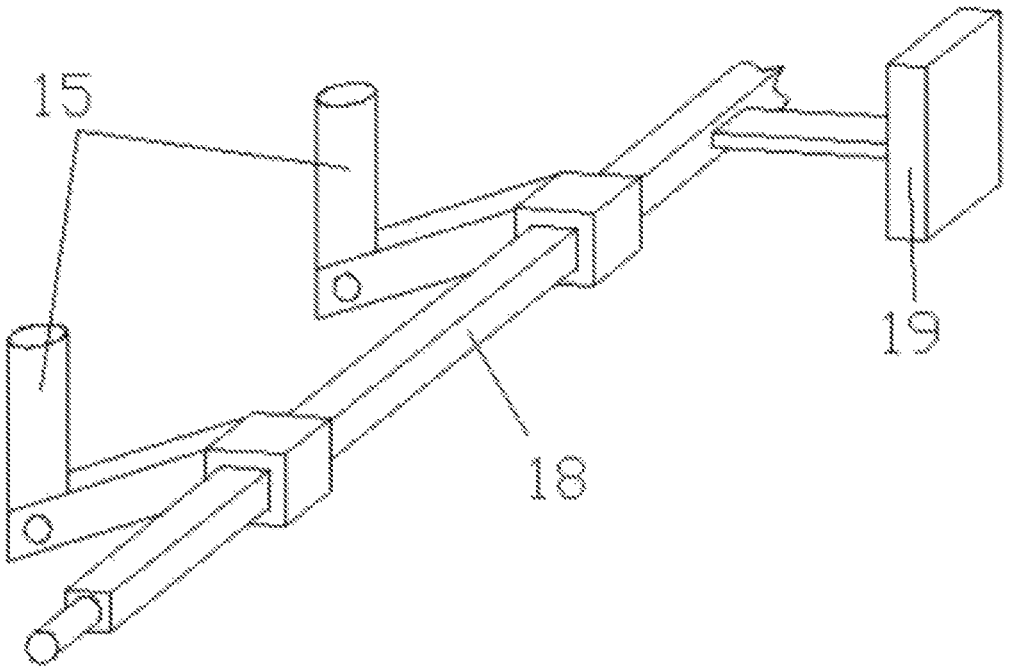
FIG. 6 is a structural diagram showing a lever structure of the present disclosure.

According to the present embodiment, one hollow cylindrical-shaped footwear brush 1 is supplied with the polish by one automatic polish ejecting system. The automatic polish ejecting system includes the hollow cylindrical polish storing barrel 12, the ejecting polish tank 13, and a lever structure. The hollow cylindrical polish storing barrel 12 is provided in the hollow portion of the hollow cylindrical-shaped footwear brush 1. An axis center of the hollow cylindrical polish storing barrel 12 coincides with an axis center of the execution channel 3. The ejecting polish tank 13 may be placed inside the hollow cylindrical polish storing barrel 12. A nozzle of the ejecting polish tank 13 may be communicated with the hollow portion of the hollow cylindrical-shaped footwear brush 1 through the polish ejecting holes 16. The hollow cylindrical polish storing barrel 12 is provided with four polish ejecting holes 16. The ejecting polish tank is provided with four nozzles. During the mounting, a positioning locker is used to make the four nozzles aligned with the four polish ejecting holes 16. During operation, the footwear polish liquid is ejected to an inner wall of the hollow cylindrical-shaped footwear brush 1 through the polish ejecting holes 16 by using the lever structure. Subsequently, the footwear polish liquid flows out to the footwear surface through the polish seeping holes 17 under the action of a high-speed rotation induced centrifugal force. An end port of the hollow cylindrical polish storing barrel 12 is connected to the execution channel 3, the other end port of the hollow cylindrical polish storing barrel 12 is connected to the self-locking cover cap 14. The ejecting polish tank 13 is placed inside the hollow cylindrical polish storing barrel 12. The self-locking cover cap 14 locks the ejecting polish tank 13. As shown in FIG. 6, the lever structure is movably provided on a base or a housing of the machine. The lever structure includes the lever 18, four push rods 15, and the polish dispensing push button 19. The four push rods 15 and the polish dispensing push button 19 are all provided on the lever 18. In a natural state, the four push rods 15 are located below the execution channels 3. When the polish dispensing push button 19 is pressed down, the lever 18 is forced to move. Being driven by the pressure from the lever 18, the push rods 15 enter the execution channels 3 and move upward toward the bottom of the ejecting polish tank 13 to force the ejecting polish tank 13 to eject the polish. According to the present embodiment, every time the polish dispensing push button 19 is pressed, the ejection of the polish is conducted once. The polish dispensing push button 19 is reset by a spring, so the number of times the user presses the button depends on the amount of polish required.

Drying and Ironing Magnetic Positioning System with Expandable Capsule

Figure 7:
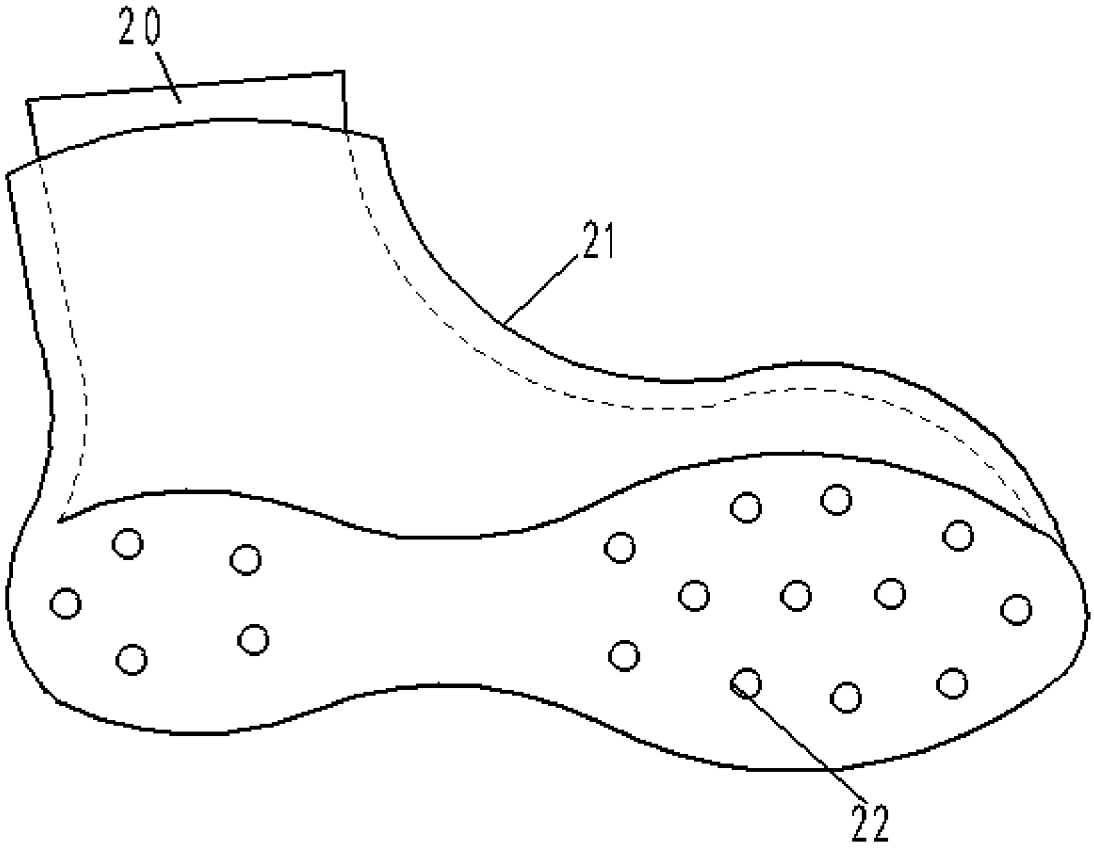
FIG. 7 is a structural diagram showing a foot-shaped electric heated drying and ironing device of the present disclosure.

As shown in FIG. 7, the drying and ironing magnetic positioning system with expandable capsule includes a foot-shaped electric-heated drying and ironing device and a magnetic positioning device. The foot-shaped electric-heated drying and ironing device can be placed inside an inner cavity of the footwear for ironing and preserving the shape of the footwear. The magnetic positioning device is magnetically connected to the foot-shaped electric-heated drying and ironing device for magnetically positioning the sole of the footwear. The specific structure is described below.

The foot-shaped electric-heated drying and ironing device includes the hydraulic/pneumatic (i.e., hydraulic type or pneumatic type) footwear shape preserving device 20 and the foot-shaped polish-proof and stain-proof protecting cover 21. The foot-shaped polish-proof and stain-proof protecting cover 21 covers on the hydraulic/pneumatic footwear shape preserving device 20. The protecting cover 21 may be disposable (the disposable protecting cover may be made of a common and cheap material), or reusable (the reusable protecting cover may be made of a special nanometer stain-proof material).

The hydraulic/pneumatic footwear shape preserving device 20 includes a foot-shaped elastic capsule. The elastic capsule is filled with fluid. A rear end of the elastic capsule is provided with a pressure component to apply pressure to the inner cavity of the elastic capsule. The pressure component and the elastic capsule are jointly sealed and are provided inside an inner cavity of a latticework frame which has a large gap. The pressure component is provided with a rotatable pushing and locking structure. The pushing and locking structure and the positioning self-locking mechanism, which has multiple levels of positioning points, on the latticework frame work collaboratively to apply pressure on the elastic capsule, lock the pressure, and release the pressure for the elastic capsule. The latticework frame (which is made of hard materials, such as metal or plastic) is used to support and hold the elastic capsule, and the elastic capsule, under pressure, expands over the large latticework gap. When the fluid is liquid, the pressure component is an electric heating device capable of moving up and down and heating the elastic capsule, which enhances the ironing effect. When the fluid is gas, the pressure component is a gas inflation device for inflating the elastic capsule. Since the footwear has varying heights, e.g. high-tops, low-tops, etc., a surface of the latticework frame is partially provided with a covering component to limit the partial deformation of the elastic capsule. The covering component can optionally block the expanding site and direction of the elastic capsule to merely apply the pressure and heat on the parts in need based on the style of the footwear. For example, when the fluid is a liquid, during use, the pressure component is pushed by hand to press the elastic capsule downward, then the pushing locking structure and the positioning self-locking mechanism are collectively locked; afterwards, the liquid in the elastic capsule, under pressure, expands over the large gap of the latticework frame in the inner cavity of the footwear in all directions and applies pressure to tightly fit with the inner cavity wall of the footwear. In this way, after the pressure component having the electronic heating device is energized, the heat and pressure can be transmitted all over the inner cavity of the footwear via the liquid. Regardless of the style and size of the footwear, a perfect pressure ironing effect can be achieved.

The magnetic positioning device includes the magnetic attraction positioning block set 22, the ferromagnetic positioning block set 23, and the foot-shaped positioning base 27. The magnetic attraction positioning block set 22 is provided on the bottom of the hydraulic/pneumatic footwear shape preserving device 20 or the bottom of the foot-shaped polish-proof and stain-proof protecting cover 21. The magnetic attraction positioning block set 22 includes a plurality of magnetic attraction positioning blocks. The plurality of magnetic attraction positioning blocks are evenly mounted at the bottom of the hydraulic/pneumatic footwear shape preserving device 20 or the bottom of the foot-shaped polish-proof and stain-proof protecting cover 21. According to the present embodiment, preferably, the plurality of magnetic attraction positioning blocks are evenly mounted on the bottom of the hydraulic/pneumatic footwear shape preserving device 20. The relative position of the magnetic attraction positioning blocks may be changed following the expansion of the elastic capsule of the hydraulic/pneumatic footwear shape preserving device 20, thereby satisfying the positioning requirements of different footwear with different sizes.

Figure 8:
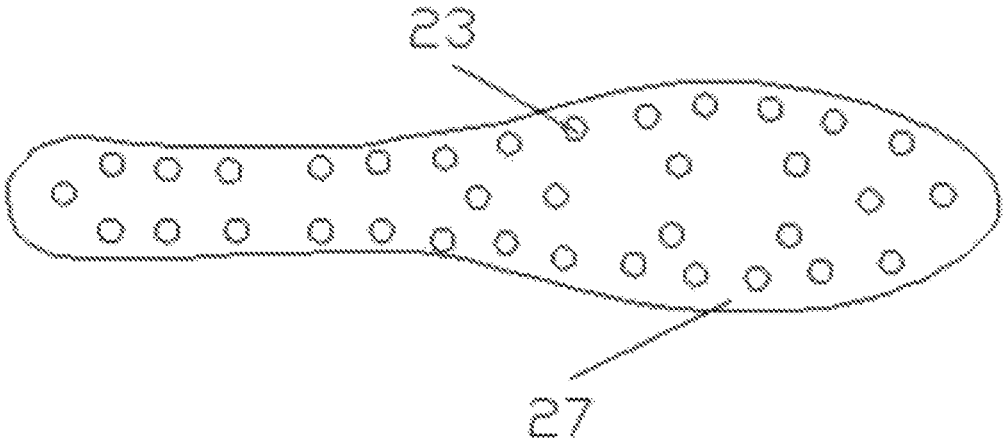
FIG. 8 is a structural diagram showing a foot-shaped positioning base of the present disclosure.

As shown in FIG. 8, the foot-shaped positioning base 27 is provided with the ferromagnetic positioning block set 23 at positions corresponding to the magnetic attraction positioning block set 22. The ferromagnetic positioning block set 23 includes a plurality of ferromagnetic positioning blocks. The plurality of ferromagnetic positioning blocks are evenly mounted on the foot-shaped positioning base 27. The ferromagnetism of the ferromagnetic positioning blocks can penetrate through the sole of the footwear to position and tightly fix the footwear to be cared. An arrangement range of the ferromagnetic positioning block set 23 depends on the width of the women's footwear of the minimum size and the length of the men's footwear of the maximum size. By doing so, it can be ensured that the footwear of any size will hold in place during polishing.

Figure 9A:
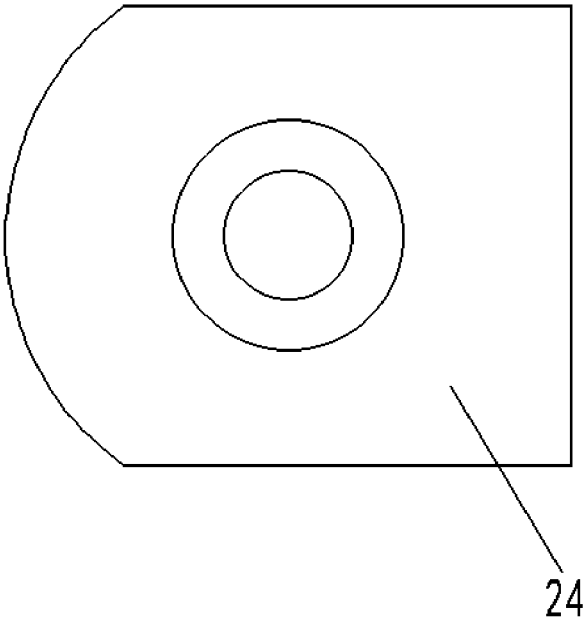
FIG. 9A is a top view of a positioning module of the present disclosure.
Figure 9B:
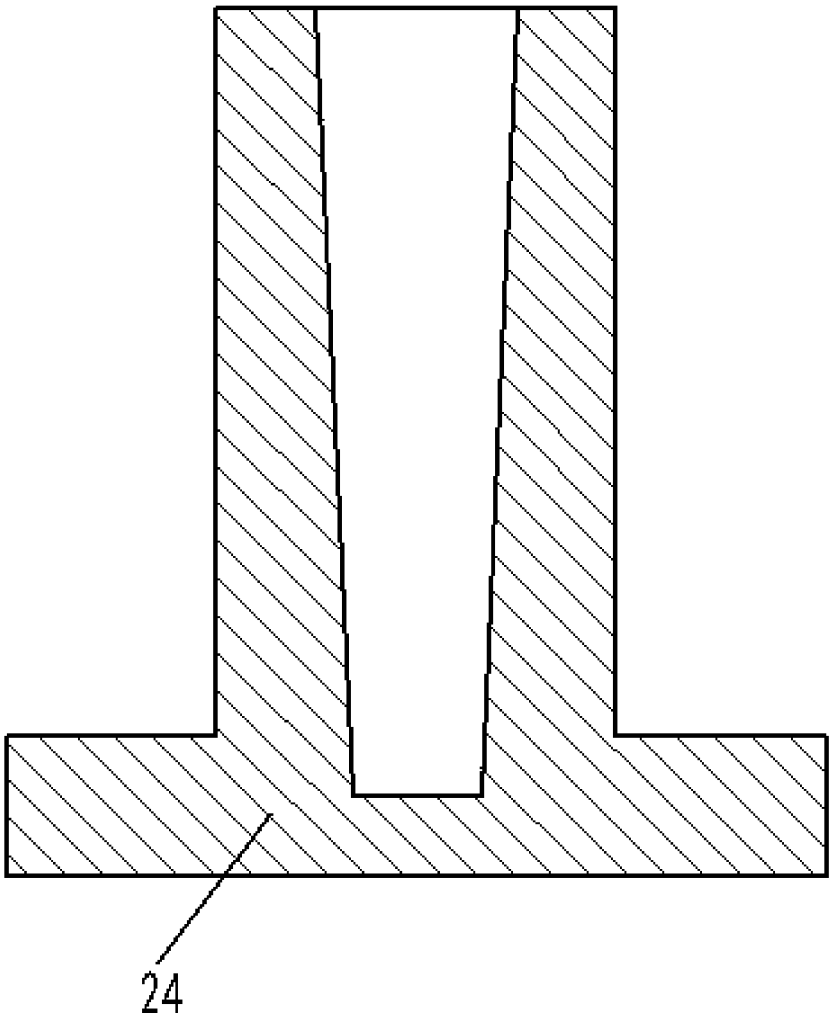
FIG. 9B is a sectional view of the positioning module of the present disclosure.

As shown in FIG. 9A and FIG. 9B, according to the present embodiment, the foot-shaped positioning base 27 is further provided with the positioning module 24 specialized for women's stilettos. The bottom of the positioning module 24 is a flat iron plate. The flat iron plate is provided with an elastic positioning block made of an elastic material (e.g., rubber, etc.). The elastic positioning block is provided with a conical groove. Simply inserting the stiletto heel in the elastic conical groove can fix the stilettos.

Figure 10:
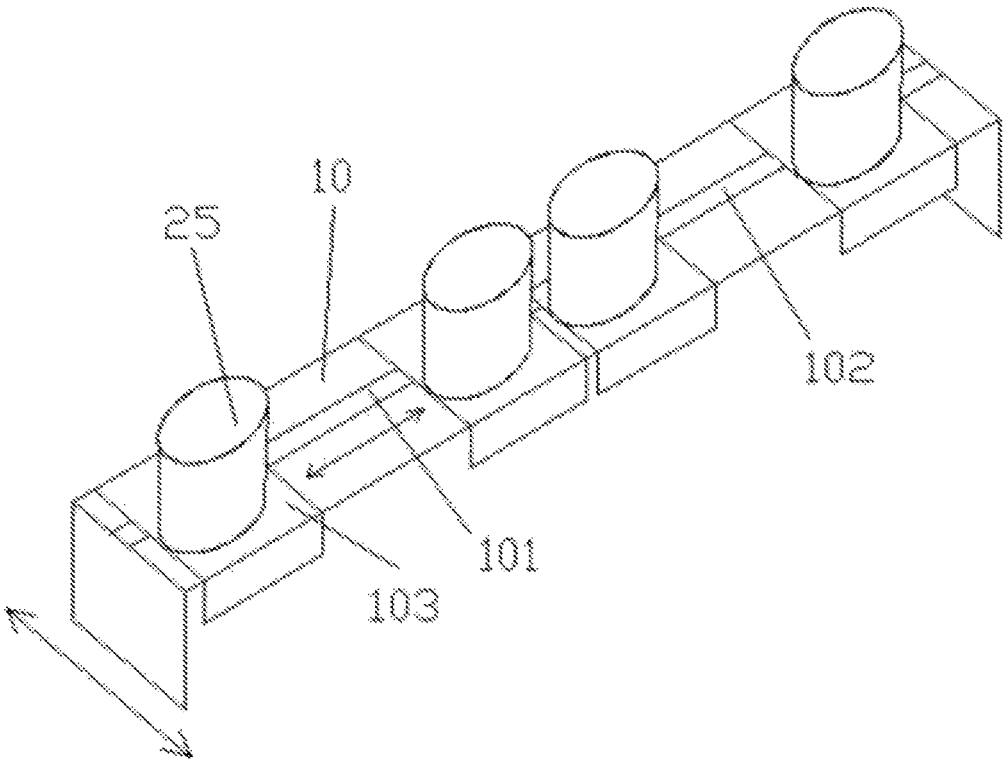
FIG. 10 is a structural diagram showing a vertical movable working platform of the present disclosure.
Figure 11:
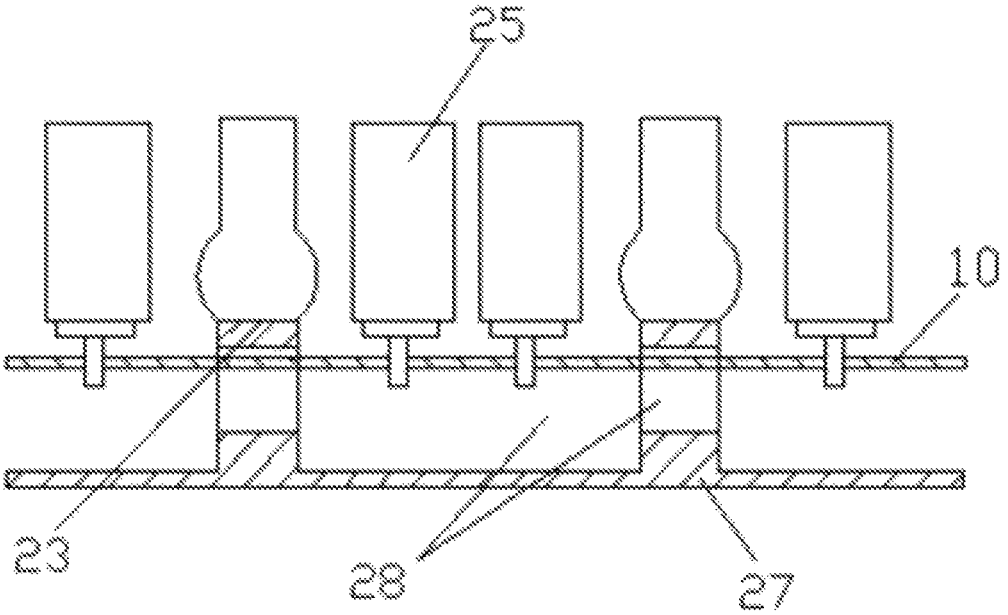
FIG. 11 is a structural diagram showing a connection of the vertical movable working platform and the foot-shaped base according to embodiment 1 of the present disclosure.

As shown in FIG. 10 and FIG. 11, the foot-shaped positioning base 27 is fixed and will not move. The movable working platform 10 is driven by a first motor to move in the operation space 28 provided below the foot-shaped positioning base 27. According to the present embodiment, the foot-shaped positioning base 27 is a hollow base with a groove. The accommodating space 28 for mounting and operating the structural components is provided between the foot-shaped positioning base 27 and the movable working platform 10. At least one multi-color combined footwear brush system 25 is provided on the movable working platform 10. The number of the multi-color combined footwear brush system provided on the movable working platform 10 is not limited in the present embodiment. One multi-color combined footwear brush system 25 is driven by one color selection drive system. One multi-color combined footwear brush system 25 is supplied with the polish by a plurality of automatic polish ejecting systems. According to the present embodiment, preferably, four multi-color combined footwear brush systems 25 are provided on the movable working platform 10. Namely, two movable platform units are provided on the movable working platform 10. One movable platform unit includes two small movable platforms 103 capable of relatively moving left and right (a relative movement includes moving toward each other and moving separately). The small movable platform 103 can be driven by the first motor or a second motor to move on the movable working platform 10 (in the present embodiment, the small movable platform 103 and movable working platform 10 may share the first motor, and achieve movement with joint action of an electromagnetic clutch; the small movable platform 103 may also be driven by the second motor alone to achieve the movement, which is not limited in the present embodiment). Each small movable platform 103 is provided with one multi-color combined footwear brush system 25. Each multi-color combined footwear brush system 25 moves along with one small movable platform 103. One multi-color combined footwear brush system 25 is driven by one color selection drive system. One multi-color combined footwear brush system 25 is provided with four hollow cylindrical-shaped footwear brushes 1. One hollow cylindrical-shaped footwear brush 1 is supplied with the polish by one automatic polish ejection system. A specific structure is shown in FIG. 10: the first two sets of the multi-color combined footwear brush systems 25 are respectively located on two sides of the left footwear, and the latter two sets of the multi-color combined footwear brush systems 25 are respectively located on two sides of the right footwear. The movable working platform 10 is provided with grooves for the multi-color combined footwear brush systems 25 to move through. Namely, the two sets of the multi-color combined footwear brush systems 25 on the two sides of the left footwear can move left and right in the first groove 101, and the two sets of the multi-color combined footwear brush systems 25 on the two sides of the right footwear can move left and right in the second groove 102. According to the present embodiment, the two sets of the multi-color combined footwear brush systems 25 of the same side of footwear can move left and right toward one another or separately according to the width of the footwear, so as to determine the initial position of the footwear. According to the present embodiment, the entire movable working platform 10 may also move back or forth. The movement of all of the movable platforms in the present embodiment can be achieved by a forward and inversely rotary screw, a gear and a rack, or a rack in combination of a travel switch or an optoelectronic switch. These structures are some universal mechanical electrical structures which will not be described in detail herein.

The present technical solution may further achieve more functions by mounting the existing universal degerming devices by employing ultraviolet light or ozone and dust cleaners.

Embodiment 2

The present technical solution may also employ a numerical control technique to set and control the color selection of footwear brushes and the footwear polish, the automatic polish dispensing amount, and a footwear polishing movement through a software program. The present technical solution employing the numerical control technique is described in detail hereinafter.

A multi-functional integrated machine for automatic caring of footwear controlled by programs in an embedded system microprocessor includes a multi-color combined footwear brush system, a color selection drive system and an automatic polish ejecting system. The multi-color combined footwear brush system is respectively connected to the color selection drive system and the automatic polish ejecting system. The automatic polish ejecting system automatically ejects polish to the multi-color combined footwear brush system. The color selection drive system drives the multi-color combined footwear brush system to switch the brush by circular motion and to polish the footwear by moving and rotating.

Each system of the present disclosure will be described in detail hereinafter with reference to the drawings.

Multi-Color Combined Footwear Brush System

Figure 2:
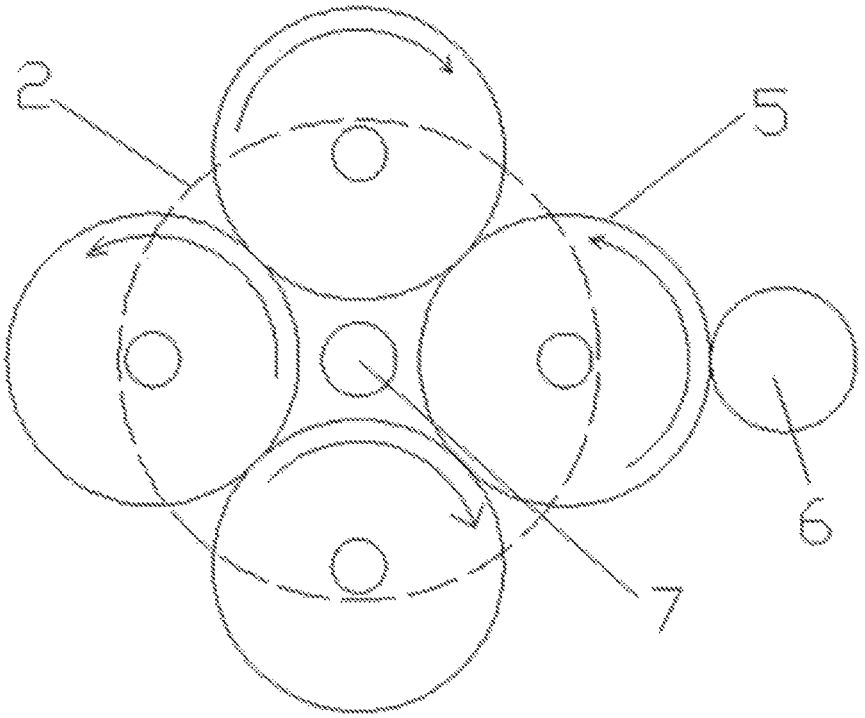
FIG. 2 is a structural diagram showing a multi-shaft transmission gear set of the present disclosure.
Figure 3:
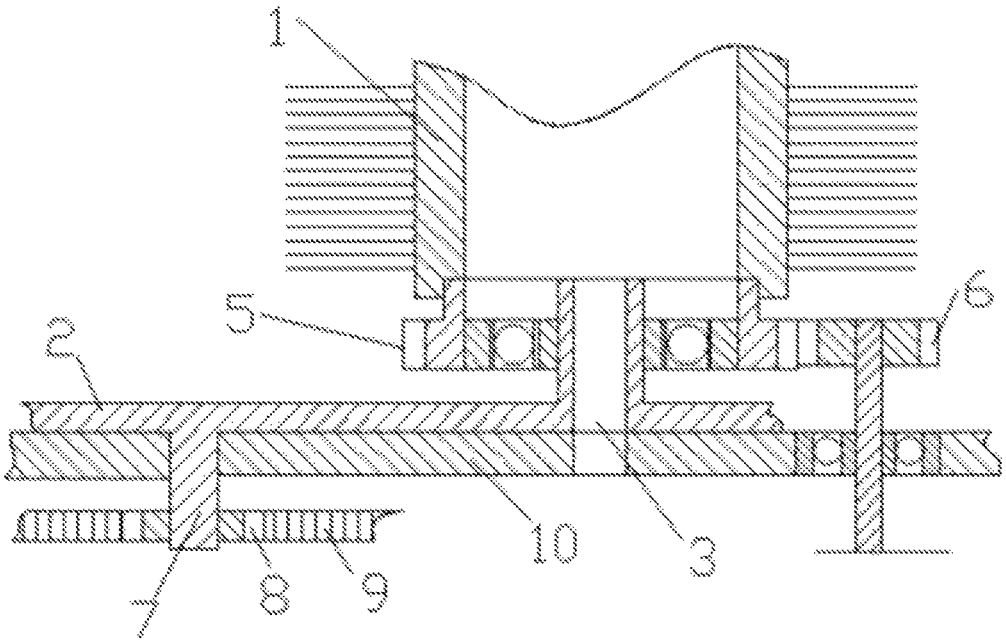
FIG. 3 is a sectional view showing a connecting structure of the multi-color combined footwear brush system and a color selection drive system of the present disclosure.
Figure 4:
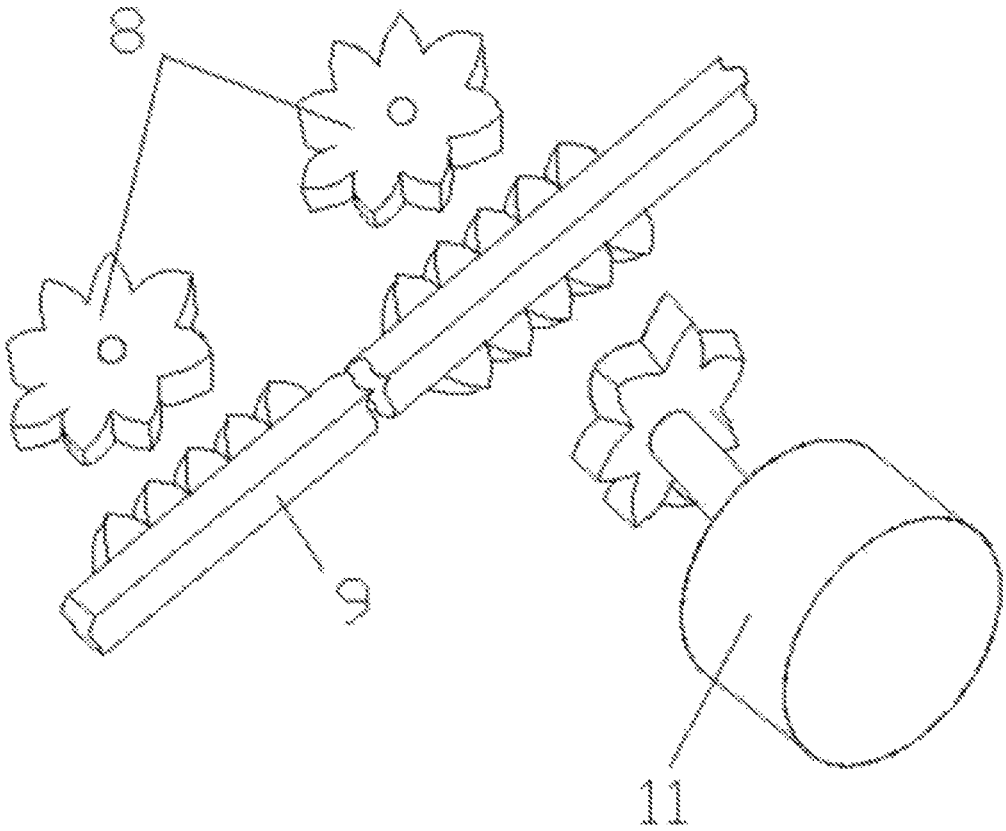
FIG. 4 is a structural diagram showing a color selection rack and a color selection gear of the present disclosure.
Figure 5:
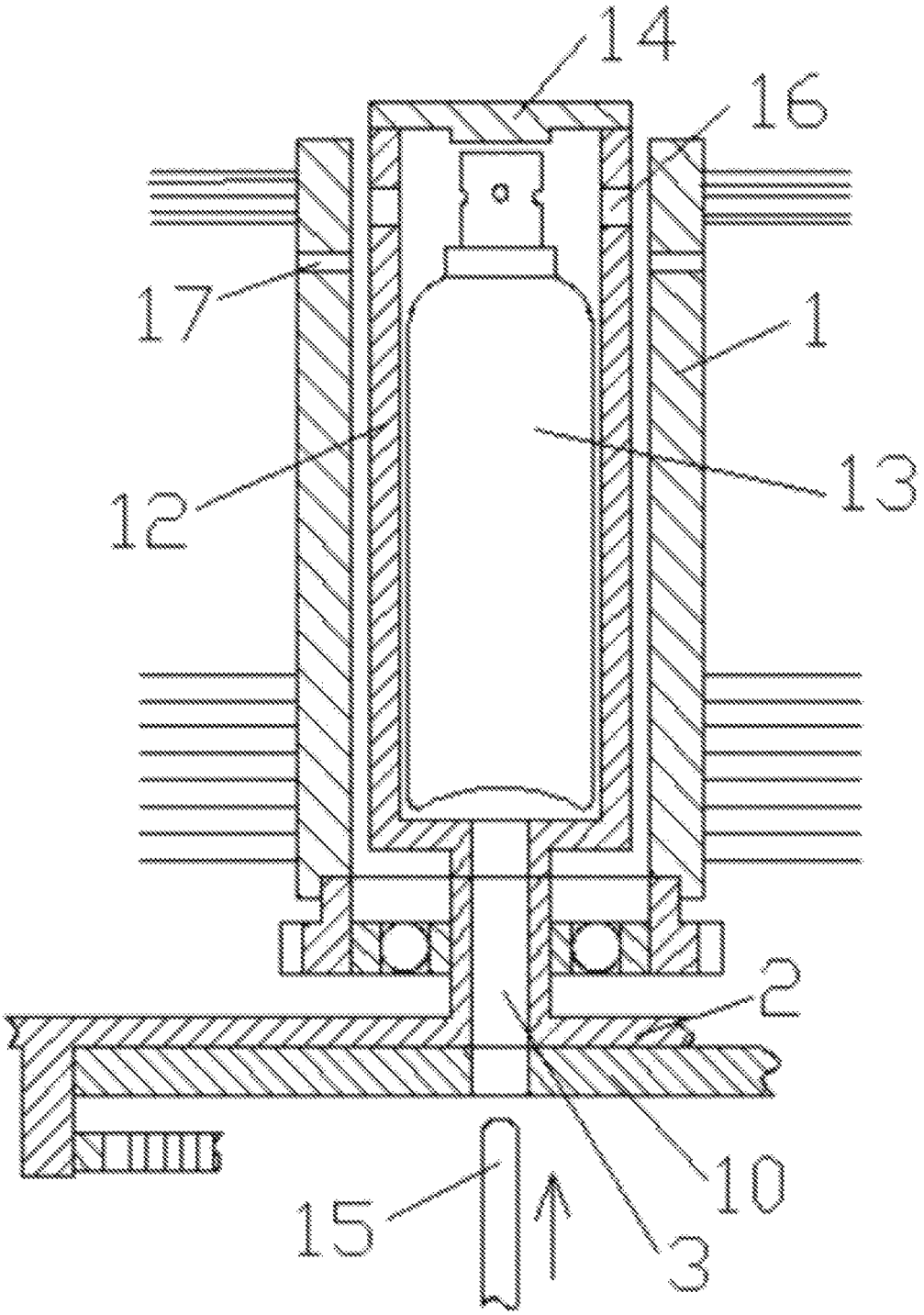
FIG. 5 is a sectional view showing a connecting structure of the multi-color combined footwear brush system and an automatic polish ejecting system of the present disclosure.
Figure 12:
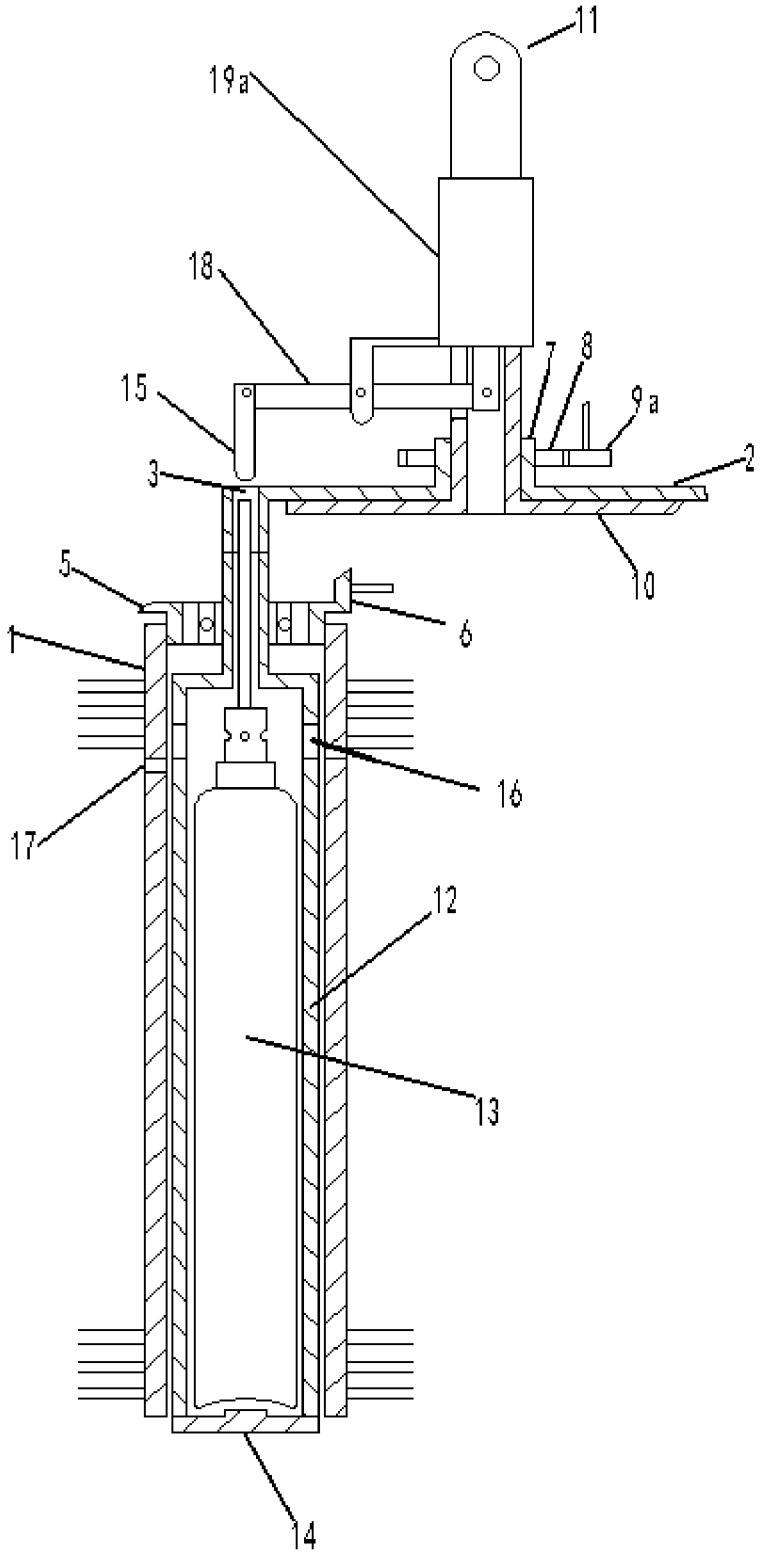
FIG. 12 is a sectional view showing a connecting structure of the multi-color combined footwear brush system, the color selection drive system, and the automatic polish ejecting system according to embodiment 2 of the present disclosure.

As shown in FIGS. 1, 2 and 12, the multi-color combined footwear brush system includes the rotary disc type color selection positioning plate 2 and four hollow cylindrical-shaped footwear brushes 1. The color selection positioning plate 2 may be configured with a plurality of hollow main shafts for mounting the plurality of hollow cylindrical-shaped footwear brushes 1 as needed. In the present embodiment, preferably, four hollow cylindrical-shaped footwear brushes 1 are employed. The four hollow cylindrical-shaped footwear brushes 1 are a black polish brush, a brown polish brush, a colorless polish brush, and a dry cleaning brush, respectively. An outer side wall of each of the hollow cylindrical-shaped footwear brushes 1 is evenly provided with the brush bristles and the polish seeping holes 17, and the hollow inner cylindrical space of the hollow cylindrical-shaped footwear brush is used to accommodate the automatic polish ejecting system. The polish seeping holes 17 communicate with the hollow portions of the hollow cylindrical-shaped footwear brushes 1. In the present embodiment, the hollow cylindrical-shaped footwear brushes 1 are movably provided on hollow shafts having the execution channels 3 of the color selection positioning plate 2. The color selection positioning plate 2 is provided with four execution channels 3. The hollow portion of each of the hollow cylindrical-shaped footwear brushes 1 is communicated with one of the execution channels 3. A side wall of the hollow cylindrical-shaped footwear brush 1 is evenly provided with a plurality of polish seeping t holes 17. In the present embodiment, the four hollow cylindrical-shaped footwear brushes 1 are evenly and circumferentially arranged on the color selection positioning plate 2. The hanging movable working platform 10 is further provided with the separation column 4 with concave arc-shaped side surfaces. Four sides of the separation column 4 are all concave arc-shaped, and the separation column 4 with concave arc-shaped side surfaces is located at the middle of the four hollow cylindrical-shaped footwear brushes 1. The concave arc-shaped surfaces are tangent to outer circles of the brush bristles of the four hollow cylindrical-shaped footwear brushes 1. The separation column 4 with concave arc-shaped side surfaces is used to separate the multi-color footwear brushes and avoid color mixing.

Color Selection Drive System

As shown in FIGS. 1, 2 and 12, the color selection drive system includes the color selection gear 8, the drive gear 9*a* of a color selection stepper motor, the power input gear 6, and the multi-shaft transmission gear set 5. The multi-shaft transmission gear set 5 is provided on a plurality of hollow shafts having an execution channel 3 of the color selection positioning plate 2 via inners ring of bearings, and the multi-shaft transmission gear set 5 is connected to the plurality of hollow cylindrical-shaped footwear brushes 1 in a driving manner. The color selection gear 8 is fixedly connected to the central main shaft 7 of the color selection positioning plate 2, and is driven by the drive gear 9*a* of the color selection stepper motor to drive the color selection positioning plate 2 to do a 0-360 degrees rotation. The color selection gear 8 is self-locked and positioned by the program of the stepper motor or positioned by a spring plunger to accomplish the operations of brush and polish switching. According to the present embodiment, the multi-shaft transmission gear set 5 includes four transmission gears. One gear is connected to one hollow cylindrical-shaped footwear brush 1 in a driving manner. The gear drives the hollow cylindrical-shaped footwear brush 1 to rotate. The power input gear 6 may establish a transmission connection with any gear of the multi-shaft transmission gear set 5. The power input gear 6 is connected to a motor and is driven by the motor. The motor is mounted on the movable working platform 10. According to the present embodiment, the hollow portion of the central main shaft 7 of the color selection positioning plate 2 passes through a main shaft of the movable working platform 10 and is sleeved on the movable working platform 10. Before the machine operates, the movable working platform 10 is located at the initial location. After the machine starts, the machine will move according to the programmed instructions of the microprocessor. After the operation is finished, the movable working platform 10 automatically returns back to the initial position. According to the present embodiment, the movable working platform 10 is of a hanging type.

Automatic Polish Ejecting System

As shown in FIG. 12, according to the present embodiment, one hollow cylindrical-shaped footwear brush 1 is supplied with the polish by one automatic polish ejecting system. The automatic polish ejecting system includes the hollow cylindrical polish storing barrel 12, the ejecting polish tank 13, a lever structure, and a polish dispensing electromagnet 19*a*. The hollow cylindrical polish storing barrel 12 is provided in the hollow portion of the hollow cylindrical-shaped footwear brush 1. An axis center of the hollow cylindrical polish storing barrel 12 coincides with an axis center of the execution channel 3. The ejecting polish tank 13 may be placed inside the hollow cylindrical polish storing barrel 12. A nozzle of the ejecting polish tank 13 can communicate with the hollow portion of the hollow cylindrical-shaped footwear brush 1 through the polish ejecting holes 16. The hollow cylindrical polish storing barrel 12 is provided with four polish ejecting holes 16. The ejecting polish tank is provided with four nozzles. During the mounting, a positioning locker is used to make the four nozzles aligned with the four polish ejecting holes 16. During operation, the footwear polish liquid is ejected to an inner wall of the hollow cylindrical-shaped footwear brush 1 through the polish ejecting holes 16 by using the lever structure. Subsequently, the footwear polish liquid flows out to the footwear surface through the polish seeping holes 17 under the action of a high-speed rotation induced centrifugal force. An end port of the hollow cylindrical polish storing barrel 12 is connected to the execution channel 3, the other end port of the hollow cylindrical polish storing barrel 12 is connected to the self-locking cover cap 14. The ejecting polish tank 13 is placed inside the hollow cylindrical polish storing barrel 12. The self-locking cover cap 14 locks the ejecting polish tank 13. The lever structure is configured on the main hanging shaft of the hanging type movable working platform 10, which includes the lever 18, the execution push rod 15, and the polish dispensing electromagnet 19*a*. The execution push rod 15 is provided on the lever 18. The polish dispensing electromagnet 19*a* is configured on the main shaft of the hanging type movable working platform 10 and is movably linked with the lever 18. In a natural state, the execution push rod 15 is located outside the execution channel 3. When the polish dispensing electromagnet 19*a* is energized, the lever 18 is forced to move. Being driven by the pressure from the lever 18, the execution push rod 15 enters the execution channel 3 and hit against the top of the pressing ejecting polish tank 13 to force the ejecting polish tank 13 to eject the polish. According to the present embodiment, every time the polish dispensing electromagnet 19*a* is energized, the ejection of the polish is conducted once. The number of times the polish ejecting is activated depends on the amount of polish required.

Drying and Ironing Magnetic Positioning System with Expandable Capsule

Figure 13:
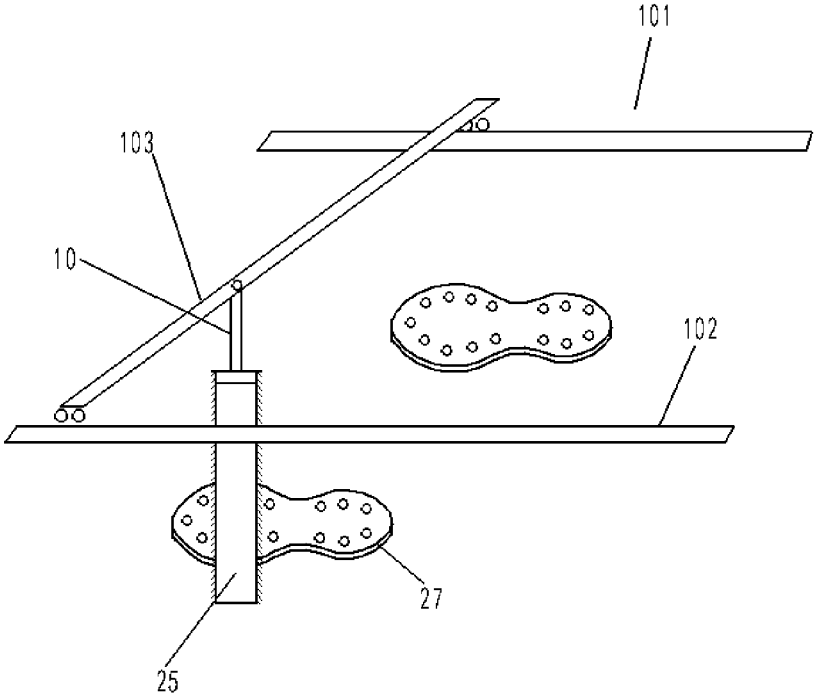
FIG. 13 is a structural diagram showing a hanging type movable working platform according to embodiment 2 of the present disclosure.

As shown in FIG. 7, the drying and ironing magnetic positioning system with expandable capsule includes a foot-shaped electric-heated drying and ironing device and a magnetic positioning device. The foot-shaped electric-heated drying and ironing device can be placed inside an inner cavity of the footwear for ironing and preserving the shape of the footwear. The magnetic positioning device is magnetically connected to the foot-shaped electric-heated drying and ironing device for magnetically positioning the sole of the footwear. The specific structure is described below. The foot-shaped electric-heated drying and ironing device includes the hydraulic/pneumatic (i.e., hydraulic type or pneumatic type) footwear shape preserving device 20 and the foot-shaped polish-proof and stain-proof protecting cover 21. The foot-shaped polish-proof and stain-proof protecting cover 21 covers on the hydraulic/pneumatic footwear shape preserving device 20. The protecting cover 21 may be disposable (the disposable protecting cover may be made of a common and cheap material), or reusable (the reusable protecting cover may be made of a special nanometer stain-proof material). The hydraulic/pneumatic footwear shape preserving device 20 includes a foot-shaped elastic capsule. The elastic capsule is filled with fluid. A rear end of the elastic capsule is provided with a pressure component to apply pressure to the inner cavity of the elastic capsule. The pressure component and the elastic capsule are jointly sealed and are provided inside an inner cavity of a latticework frame which has a large gap. The pressure component is provided with a rotatable pushing and locking structure. The pushing and locking structure and the positioning self-locking mechanism, which has multiple levels of positioning points, on the latticework frame work collaboratively to apply pressure on the elastic capsule, lock the pressure, and release the pressure for the elastic capsule. The latticework frame (which is made of hard materials, such as metal or plastic) is used to support and hold the elastic capsule, and the elastic capsule, under pressure, expands over the large latticework gap. When the fluid is liquid, the pressure component is an electric heating device capable of moving up and down and heating the elastic capsule, which enhances the ironing effect. When the fluid is gas, the pressure component is a gas inflation device for inflating the elastic capsule. Since the footwear has varying heights, e.g. high-tops, low-tops, etc., a surface of the latticework frame is partially provided with a covering component to limit the partial deformation of the elastic capsule. The covering component can optionally block the expanding site and direction of the elastic capsule to merely apply the pressure and heat on the parts in need based on the style of the footwear. For example, when the fluid is a liquid, during use, the pressure component is pushed by hand to press the elastic capsule downward, then the pushing locking structure and the positioning self-locking mechanism are collectively locked; afterwards, the liquid in the elastic capsule, under pressure, expands over the large gap of the latticework frame in the inner cavity of the footwear in all directions and applies pressure to tightly fit with the inner cavity wall of the footwear. In this way, after the pressure component having the electronic heating device is energized, the heat and pressure can be transmitted all over the inner cavity of the footwear via the liquid. Regardless of the style and size of the footwear, a perfect pressure ironing effect can be achieved. The magnetic positioning device includes the magnetic attraction positioning block set 22, the ferromagnetic positioning block set 23, and the foot-shaped positioning base 27. The magnetic attraction positioning block set 22 is provided on the bottom of the hydraulic/pneumatic footwear shape preserving device 20 or the bottom of the foot-shaped polish-proof and stain-proof protecting cover 21. The magnetic attraction positioning block set 22 includes a plurality of magnetic attraction positioning blocks. The plurality of magnetic attraction positioning blocks are evenly mounted at the bottom of the hydraulic/pneumatic footwear shape preserving device 20 or the bottom of the foot-shaped polish-proof and stain-proof protecting cover 21. According to the present embodiment, preferably, the plurality of magnetic attraction positioning blocks are evenly mounted on the bottom of the hydraulic/pneumatic footwear shape preserving device 20. The relative position of the magnetic attraction positioning blocks may be changed following the expansion of the elastic capsule of the hydraulic/pneumatic footwear shape preserving device 20, thereby satisfying the positioning requirements of different footwear with different sizes. As shown in FIG. 8, the foot-shaped positioning base 27 is provided with the ferromagnetic positioning block set 23 at positions corresponding to the magnetic attraction positioning block set 22. The ferromagnetic positioning block set 23 includes a plurality of ferromagnetic positioning blocks. The plurality of ferromagnetic positioning blocks are evenly mounted on the foot-shaped positioning base 27. The ferromagnetism of the ferromagnetic positioning blocks can penetrate through the sole of the footwear to position and tightly fix the footwear to be cared. An arrangement range of the ferromagnetic positioning block set 23 depends on the width of the women's footwear of the minimum size and the length of the men's footwear of the maximum size. By doing so, it can be ensured that the footwear of any size will be holden in place during polishing. As shown in FIG. 9A and FIG. 9B, according to the present embodiment, the foot-shaped positioning base 27 is further provided with the positioning module 24 specialized for women's stilettos. The bottom of the positioning module 24 is a flat iron plate. The flat iron plate is provided with an elastic positioning block made of an elastic material (e.g., rubber, etc.). The elastic positioning block is provided with a conical groove. Simply inserting the stiletto heel in the elastic conical groove can fix the stilettos. As shown in FIG. 13, the foot-shaped positioning base 27 is fixed and will not move. At least one hanging type movable moving platform 10 is provided above the foot-shaped positioning base. The hanging type movable moving platform 10 is driven by the motor controlled by the programs in the microprocessor to move back, forth, leftward, and rightward on the longitudinally and transversely moving guide rails 101, 102, and 103 above the foot-shaped positioning base 27, can swing along a horizontal line of the transversely moving guide rail 103 by 0-180 degrees through the hanging swinging rod 11. Each hanging movable working platform 10 is provided with one multi-color combined footwear brush system. One multi-color combined footwear brush system is driven by one color selection drive system and is supplied with the polish by a plurality of automatic polish ejecting systems. According to the present embodiment, one multi-color combined footwear brush system 25 is provided on the hanging type movable working platform 10. The number of the hanging type movable working platform 10 provided on the transversely moving guide rail 103 is not limited in the present embodiment. One multi-color combined footwear brush system 25 is driven by one color selection drive system. One multi-color combined footwear brush system 25 is further supplied with the polish by a plurality of automatic polish ejecting systems. In the present embodiment, preferably, only one hanging type movable working platform 10 is required which can be detected for the location and state through various sensors such as an infrared sensor or an ultrasonic sensor. The hanging type movable working platform can move back, forth, leftward and rightward according to the instructions of the embedded microprocessor to respectively polish the left and right footwear as needed. These movements can be achieved by a forward and inversely rotary screw, a gear and a rack, an idler wheel, or a guide rail, etc. These structures are related to some universal sensor detections, embedded system microprocessors and common mechanical and electrical structures, which will not be described in detail herein.

A method of using the present embodiment is as follows: before starting the machine, the foot-shaped electric-heated drying and ironing device is placed in the inner cavity of the footwear first, and the footwear is placed on the foot-shaped positioning base for fixation. Subsequently, the polish type, the color of the footwear brush, and the polish dispensing amount are selected on a liquid crystal display or a panel with set buttons. Then, the machine is started, and the whole course of processes including drying, ironing, shape preserving, degerming, and polish applying is carried out automatically. When the machine automatically returns to the initial position, the machine stops operation.

The aforementioned description merely involves a couple of preferred embodiments of the present application, and the present application is not limited thereto. Any change that can be derived by those skilled in the art should be considered as falling within the scope of the present application.

What is claimed is:

1. A multi-functional integrated machine for automatic caring of footwear, comprising:

an automatic polish ejecting system;

a drying and ironing magnetic positioning system with an expandable capsule;

a multi-color combined footwear brush system; and a color selection drive system;

wherein the automatic polish ejecting system automatically ejects polish to the multi-color combined footwear brush system, the multi-color combined footwear brush system is respectively connected to the color selection drive system and the automatic polish ejecting system, and the color selection drive system drives the multi-color combined footwear brush system to switch a brush by circular motion and to polish the footwear by moving and rotating; and wherein the drying and ironing magnetic positioning system with the expandable capsule comprises a foot-shaped electric-heated drying and ironing device and a magnetic positioning device, the foot-shaped electric-heated drying and ironing device is placed inside an inner cavity of the footwear to iron the footwear and preserve a shape of the footwear, and the magnetic positioning device is magnetically connected to the foot-shaped electric-heated drying and ironing device for magnetically positioning a sole of the footwear.

2. The multi-functional integrated machine for automatic caring of footwear according to claim 1, wherein the foot-shaped electric-heated drying and ironing device comprises a hydraulic or pneumatic footwear shape preserving device and a foot-shaped polish-proof and stain-proof protecting cover, the foot-shaped polish-proof and stain-proof protecting cover covers over the hydraulic or pneumatic footwear shape preserving device;

the magnetic positioning device comprises a magnetic attraction positioning block set, a ferromagnetic positioning block set, and a foot-shaped positioning base, the magnetic attraction positioning block set is provided on a bottom of the hydraulic or pneumatic footwear shape preserving device or a bottom of the foot-shaped polish-proof and stain-proof protecting cover, and the ferromagnetic positioning block set is provided on the foot-shaped positioning base.

3. The multi-functional integrated machine for automatic caring of footwear according to claim 2, wherein a movable working platform is provided around the foot-shaped positioning base, the movable working platform is driven by a motor to move forth, back, rightward, and leftward, and swing by 0-180 degrees along the foot-shaped positioning base, the movable working platform is provided with the multi-color combined footwear brush system.

4. The multi-functional integrated machine for automatic caring of footwear according to claim 2, wherein the foot-shaped positioning base is further provided with a positioning module specialized for women stilettos, a bottom of the positioning module is a flat iron plate, the flat iron plate is provided with an elastic positioning block, and the elastic positioning block is provided with a conical groove.

5. A multi-functional integrated machine for automatic caring of footwear, comprising a multi-color combined footwear brush system, a color selection drive system and an automatic polish ejecting system;

wherein the multi-color combined footwear brush system is respectively connected to the color selection drive system and the automatic polish ejecting system, the automatic polish ejecting system automatically ejects polish to the multi-color combined footwear brush system, and the color selection drive system drives the multi-color combined footwear brush system to switch a brush by circular motion and to polish the footwear by moving and rotating; and wherein the multi-color combined footwear brush system comprises a color selection positioning plate and a plurality of hollow cylindrical-shaped footwear brushes, the plurality of hollow cylindrical-shaped footwear brushes are movably provided on the color selection positioning plate, the automatic polish ejecting system is provided in a hollow portion of each hollow cylindrical-shaped footwear brush, the color selection positioning plate is provided with a plurality of execution channels, the hollow portion of each hollow cylindrical-shaped footwear brush is connected to one of the execution channels, a side wall of each hollow cylindrical-shaped footwear brush is evenly provided with a plurality polish seeping holes, the polish seeping holes are connected to the hollow portion of each hollow cylindrical-shaped footwear brush, and the plurality of hollow cylindrical-shaped footwear brushes are driven by the color selection drive system.

6. The multi-functional integrated machine for automatic caring of footwear according to claim 5, wherein the color selection drive system comprises a color selection gear, a color selection rack, a power input gear, and a multi-shaft transmission gear set, the color selection gear is fixedly connected to a central main shaft of the color selection positioning plate, a plurality of gears of the multi-shaft transmission gear set are provided on the color selection positioning plate to establish a multi-shaft transmission, the plurality of gears are respectively one-to-one connected to the hollow cylindrical-shaped footwear brushes in a driving manner, the power input gear is connected to the multi-shaft transmission gear set in a transmission manner, and the power input gear is connected to a drive motor in a driving manner.

7. The multi-functional integrated machine for automatic caring of footwear according to claim 6, wherein the multi-color combined footwear brush system further comprises a separation column with concave arc-shaped side surfaces, the separation column with concave arc-shaped side surfaces is provided in a middle of the plurality of hollow cylindrical-shaped footwear brushes, and a concave arc of each concave arc-shaped side surface is tangent to an outer circle of brush bristles on a corresponding hollow cylindrical-shaped footwear brush.

8. The multi-functional integrated machine for automatic caring of footwear according to claim 6, wherein the color selection drive system further comprises a color selection rotary knob or a color selection stepper motor, the color selection rotary knob or the color selection stepper motor is connected to the color selection gear, the color selection rotary knob or the color selection stepper motor drives the color selection rack and the color selection gear to perform a color selection, and the color selection rotary knob or the color selection stepper motor is positioned through a spring plunger, or a self-locking program.

9. The multi-functional integrated machine for automatic caring of footwear according to claim 6, wherein the automatic polish ejecting system comprises a hollow cylindrical polish storing barrel, an ejecting polish tank, and a lever structure;

the hollow cylindrical polish storing barrel is provided in the hollow portion of each hollow cylindrical-shaped footwear brush, the ejecting polish tank is placed inside the hollow cylindrical polish storing barrel, an ejecting nozzle of the ejecting polish tank communicates with the hollow portion of the hollow cylindrical-shaped footwear brush through a polish ejecting hole of the hollow cylindrical polish storing barrel;

a first end port of the hollow cylindrical polish storing barrel is connected to one of the execution channels, a second end port of the hollow cylindrical polish storing barrel is connected to a self-locking cover cap, the ejecting polish tank is placed inside the hollow cylindrical polish storing barrel, and the self-locking cover cap locks the ejecting polish tank;

the lever structure comprises a lever, a plurality of push rods, and a polish dispensing push button or a polish dispensing electromagnet, the plurality of push rods are provided on the lever, and the polish dispensing push button or the polish dispensing electromagnet is connected to the lever; and in a natural state, the plurality of push rods are located outside the execution channels, when the polish dispensing push button is pressed down or the polish dispensing electromagnet is energized, the push rods enter the execution channels to push and press an end of the ejecting polish tank, then the ejecting polish tank starts ejecting the polish.

10. A multi-color combined footwear brush system, comprising a color selection positioning plate and a plurality of hollow cylindrical-shaped footwear brushes;

wherein the plurality of hollow cylindrical-shaped footwear brushes are movably provided on the color selection positioning plate, an automatic polish ejecting system is provided in a hollow portion of each hollow cylindrical-shaped footwear brush, the color selection positioning plate is provided with a plurality of execution channels, the hollow portion of each hollow cylindrical-shaped footwear brush is connected to one of the execution channels, a side wall of each hollow cylindrical-shaped footwear brush is evenly provided with a plurality of polish seeping holes, the polish seeping holes are connected to the hollow portion of each hollow cylindrical-shaped footwear brush, and the plurality of hollow cylindrical-shaped footwear brushes are driven by a color selection drive system.

11. The multi-color combined footwear brush system according to claim 10 further comprising a separation column with concave arc-shaped side surfaces, wherein the separation column with concave arc-shaped side surfaces is provided in a middle of the plurality of hollow cylindrical-shaped footwear brushes, and a concave arc of each concave arc-shaped side surface is tangent to an outer circle of brush bristles on a corresponding hollow cylindrical-shaped footwear brush.

12. An automatic polish ejecting system, comprising a color selection positioning plate provided with a plurality of execution channels, a hollow cylindrical polish storing barrel, an ejecting polish tank, and a lever structure;

the hollow cylindrical polish storing barrel is provided in a hollow portion of a hollow cylindrical-shaped footwear brush, the ejecting polish tank is placed inside the hollow cylindrical polish storing barrel, an ejecting nozzle of the ejecting polish tank communicates with the hollow portion of the hollow cylindrical-shaped footwear brush through a polish ejecting hole of the hollow cylindrical polish storing barrel;

a first end port of the hollow cylindrical polish storing barrel is connected to one execution channel of the plurality of execution channels, a second end port of the hollow cylindrical polish storing barrel is connected to a self-locking cover cap, the ejecting polish tank is placed inside the hollow cylindrical polish storing barrel, and the self-locking cover cap locks the ejecting polish tank;

the lever structure comprises a lever, a plurality of push rods, and a polish dispensing push button or a polish dispensing electromagnet, the plurality of push rods are provided on the lever, and the polish dispensing push button or the polish dispensing electromagnet is connected to the lever; and in a natural state, the plurality of push rods are located outside the plurality of execution channels, when the polish dispensing push button is pressed down or the polish dispensing electromagnet is energized, the push rods enter the execution channels to push and press an end of the ejecting polish tank, then the ejecting polish tank starts ejecting the polish.

* * * * *